US009523266B2

(12) United States Patent
Arena

(10) Patent No.: US 9,523,266 B2
(45) Date of Patent: Dec. 20, 2016

(54) SYSTEM TO PERFORATE A CEMENTED LINER HAVING LINES OR TOOLS OUTSIDE THE LINER

(75) Inventor: Michele Arena, Rome (IT)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 762 days.

(21) Appl. No.: 12/464,438

(22) Filed: May 12, 2009

(65) Prior Publication Data

US 2009/0288879 A1 Nov. 26, 2009

Related U.S. Application Data

(60) Provisional application No. 61/054,589, filed on May 20, 2008.

(51) Int. Cl.
*E21B 43/119* (2006.01)
*E21B 23/02* (2006.01)

(52) U.S. Cl.
CPC ..... *E21B 43/119* (2013.01); *E21B 23/02* (2013.01)

(58) Field of Classification Search
CPC ..... E21B 23/02; E21B 23/03; E21B 43/119; E21B 43/11; E21B 43/116; E21B 43/117
USPC ..... 166/255.2, 285, 297, 376, 55.2, 55
See application file for complete search history.

(56) References Cited

U.S. PATENT DOCUMENTS 3,653,435 A * 4/1972 Reistle et al. ..... 166/366
3,656,562 A * 4/1972 Baugh ..... 175/4.51
5,358,039 A 10/1994 Fordham
5,361,843 A * 11/1994 Shy ..... E21B 17/00 166/242.1
5,996,711 A * 12/1999 Ohmer ..... 175/61
6,012,527 A 1/2000 Nitis et al.
6,173,773 B1 1/2001 Almaguer
6,209,635 B1 4/2001 Gotlib et al.
6,230,806 B1 * 5/2001 Gano ..... 166/313
6,354,374 B1 3/2002 Edwards
6,378,610 B2 4/2002 Rayssiguier et al.
6,419,022 B1 7/2002 Jernigan et al.
6,499,541 B1 12/2002 Hiron
6,561,289 B2 5/2003 Portman et al.
6,755,256 B2 6/2004 Murley
6,827,149 B2 12/2004 Hache
6,873,267 B1 * 3/2005 Tubel et al. ..... 340/853.3
6,903,660 B2 6/2005 Clark
7,071,697 B2 7/2006 Rioufol
(Continued)

OTHER PUBLICATIONS

PCT/US2009/043606, International Search Report and Written Opinion, dated Jul. 7, 2009, 9 pgs.

*Primary Examiner* — Elizabeth Gitlin
(74) *Attorney, Agent, or Firm* — Tuesday Kaasch

(57) ABSTRACT

A downhole perforating system having a cemented-in lower completion including one or more orienting nipples, each orienting nipple having a recess key, and one or more lines or tools carried on the exterior of the lower completion and oriented relative to the recess key. The downhole perforating system also includes a perforating string having one or more blank sections oriented relative to an orienting key that is brought into alignment with the recess key when the perforating string is landed in the orienting nipple. Upon landing, the perforating string can be fired without damaging the lines or tools outside the lower completion.

16 Claims, 6 Drawing Sheets

(56) References Cited

U.S. PATENT DOCUMENTS

| | | | | |
|---|---|---|---|---|
| 7,147,060 | B2 | 12/2006 | Huber | |
| 7,185,703 | B2 | 3/2007 | Jannise et al. | |
| 7,237,616 | B2 | 7/2007 | Patel | |
| 7,347,275 | B2 | 3/2008 | Fontenot | |
| 7,398,822 | B2 | 7/2008 | Meijer | |
| 7,413,021 | B2 | 8/2008 | Madhavan | |
| 7,493,959 | B2 | 2/2009 | Johnson | |
| 7,493,962 | B2 | 2/2009 | Sheffield | |
| 7,503,395 | B2 | 3/2009 | Meijer | |
| 7,635,029 | B2 | 12/2009 | MacDougall | |
| 2004/0144539 | A1* | 7/2004 | Smith et al. | 166/297 |

* cited by examiner

SYSTEM TO PERFORATE A CEMENTED LINER HAVING LINES OR TOOLS OUTSIDE THE LINER

CROSS-REFERENCE TO OTHER APPLICATIONS

This application claims priority to and the benefit of U.S. Provisional Application Ser. No. 61/054,589, filed on May 20, 2008.

TECHNICAL FIELD

The present application relates generally to the field of perforating liner in a wellbore, and particularly to conveying and orienting a perforating device to a desired location and orientation in the wellbore.

BACKGROUND

A well used to produce fluids, such as oil, gas, or water, preferably is "completed" by placing completion hardware or tools permanently or semi-permanently in the wellbore. The completion hardware or tools may include, for example, valves, packers, screens, and various other devices designed to protect the well or assist in the recovery of the fluids.

A typical subterranean well includes a casing string that lines the wellbore wall. The casing string is generally installed by running it into the wellbore and cementing it in place. The cementing process typically includes pumping a desired volume of cement into a central passageway of the casing string. Once the desired volume of cement has been pumped, a different fluid such as drilling fluid or "mud", is pumped into the central passageway of the casing string, causing the cement to be displaced from the central passageway and into the annular region between the wellbore wall and the casing string. The cement sets in the annulus and bonds the casing string to the wellbore wall. The well may also have a liner and the liner is also cemented in the wellbore. Liner differs from casing in that a liner is hung from the bottom of a casing or another liner and not connected to the surface (as is casing).

Once the wellbore is cased, the formation fluids are sealed off from the interior of the casing or liner. In those zones adjacent reservoir rocks having desirable formation fluids, the casing is perforated to establish fluid communication between the formation fluids and the interior of the casing or liner so those fluids can be produced. This is typically done using a perforating gun. The perforating gun is lowered into the wellbore to a desired depth and, upon command, fires shaped charges radially outward through the casing or liner and into the formation, forming holes in the casing or liner and perforation tunnels in the formation.

SUMMARY

Various preferred embodiments relate to a downhole perforating system having a cemented-in lower completion including one or more orienting nipples, each orienting nipple having a recess key, and one or more lines or tools carried on the exterior of the lower completion and oriented relative to the recess key. The downhole perforating system also includes a perforating string having one or more blank sections oriented relative to an orienting key that is brought into alignment with the recess key when the perforating string is landed in the orienting nipple. Upon landing, the perforating string can be fired without damaging the lines or tools outside the lower completion.

Other aspects and advantages will become apparent from the following description and the attached claims.

It is to be understood that the drawings are to be used for the purpose of understanding various embodiments and/or features. The figures are not intended to unduly limit any present or future claims related to this application.

DETAILED DESCRIPTION

Some specific embodiments will now be described with reference to the figures. Like elements in the various figures will be referenced with like numbers for consistency. In the following description, numerous details are set forth to provide an understanding of various embodiments and/or features. However, it will be understood by those skilled in the art that the present invention may be practiced without many of these details and that numerous variations or modifications from the described embodiments are possible. As used here, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left or diagonal relationship as appropriate.

Production wells are normally completed in two or more completion stages. The stage or portion of the completion that runs adjacent to a reservoir is commonly called the "lower completion", and the portion above the lower completion is generally referred to as the "upper completion". The lower completion includes the tools and hardware used to collect the production fluid, and the upper completion serves to hydraulically connect the lower completion to the surface or wellhead. Special downhole connectors known as "wet connectors" are used between the upper and lower completions when hydraulic, pneumatic, electrical, and/or optical lines (hereinafter, "lines") need to be reconnected up to surface.

Figure 1:
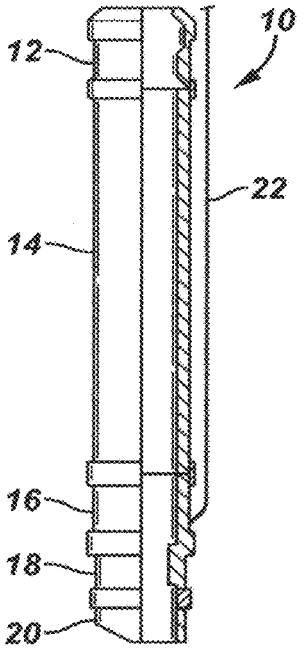
FIG. 1 is a partially cutaway schematic drawing showing various components comprising the lowermost portion of a lower completion that may be used in accordance with various embodiments.

FIG. 1 shows various components comprising the lowermost portion of a typical lower completion 10. Such a portion may be used in accordance with the present invention, though other tool and hardware combinations are possible. The embodiment shown in FIG. 1 includes a modified quick connector 12, a liner section 14, a representative downhole tool and/or turnaround sub 16, a polished bore receptacle (PBR) 18, and a re-entry guide 20. Each of those components is connected end-to-end to its adjoining component(s). Lower completion 10 also includes lines 22 that are carried on the exterior surfaces of the various components of lower completion 10 and that terminate at their lower ends in one or more downhole tools 16. Running lines 22 on the outside of lower completion 10 helps to maximize the internal completion geometries and downhole tool contact to the reservoir. That is, better measurements from, for example, downhole gauges, fiber optic sensors, temperature arrays, etc. may be obtained if the lines and tools are run behind (i.e., outside) lower completion 10.

Figure 2A:
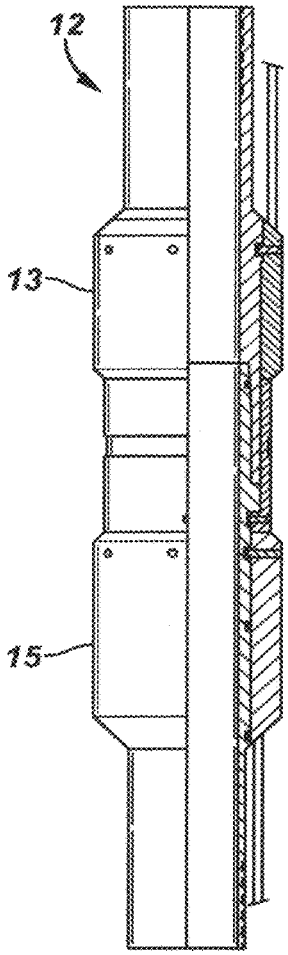
FIG. 2A is a partially cutaway schematic drawing showing details of the modified quick connector shown in FIG. 1.

The quick connector 12 can be used in a lower completion to connect tools that require a specific orientation. The quick connector 12 may comprise upper and lower halves with a clutch interface to transmit torque when the two halves are joined. The two halves are stabbed together and the collar (and only the collar) is rotated to secure the two halves together, as is well known in the art. For a present embodiment, a modified quick connector 12 has upper and lower orienting subs 13, 15 (FIG. 2A) that align an indexing casing coupler (ICC) or orienting nipple recess key 24, run above quick connector 12, with respect to lines 22 and protect lines 22 while running the lower completion 10 into the wellbore.

Liner 14 may comprise three individual tubulars or "joints" that are joined together to form what is called a "stand" of pipe. Preferably one modified quick connector 12 is used with each stand of liner 14. That provides an attachment point for lines 22 approximately every 30 meters. Cross-coupling protectors may also be used at every joint to further protect lines 22 if the lower completion 10 is deployed in a particularly harsh wellbore environment.

Figure 2B:
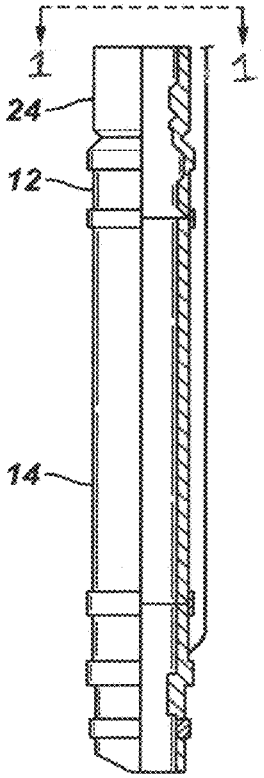
FIG. 2B is a partially cutaway schematic drawing showing an orienting nipple joined to the portion of the lower completion shown in FIG. 1.
Figure 2C:
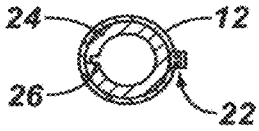
FIG. 2C is a cross-sectional view of the lower completion shown in FIG. 2B, taken through the orienting nipple.
Figure 12:
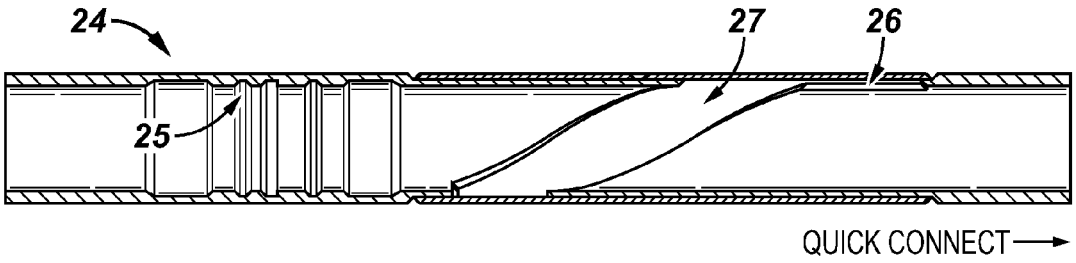
FIG. 12 is a cross-sectional view of the orienting nipple shown in FIG. 3A, cut by a plane containing the longitudinal axis of the orienting nipple.

An ICC or orienting nipple 24 is shown in FIG. 2B engaged with modified quick connector 12. For completions, a nipple is a short section of heavy wall tubular with a machined internal surface that provides a seal area and a locking profile 25 (FIG. 12). Landing nipples are included in most completions at predetermined intervals to enable the installation of desired downhole tools at particular locations in the casing, liner, or tubing string. As alluded to above, orienting nipple 24 works in conjunction with modified quick connector 12 to orient a recess key 26 relative to lines 22. In the embodiment shown in FIG. 2C, recess key 26 is oriented 180 degrees away from lines 22. The utility of this orientation will be discussed further below. Orienting nipple 24 also has a guiding surface 27 (FIG. 12) that terminates into recess key 26.

Figure 3:
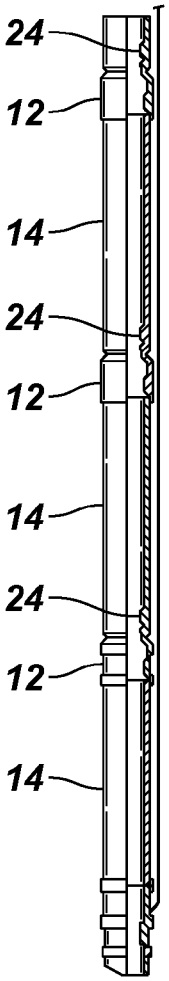
FIG. 3 is a partially cutaway schematic drawing showing repeated sections comprising a liner, a quick connect, and an orienting nipple joined to the portion of the lower completion shown in FIG. 2B.
Figure 4:
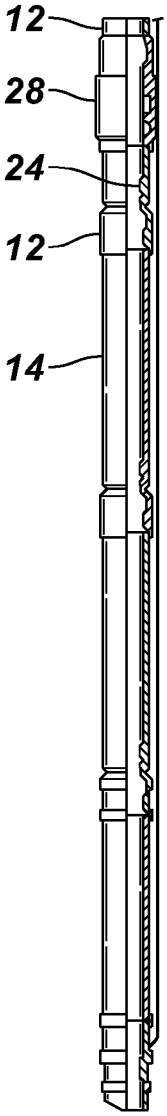
FIG. 4 is a partially cutaway schematic drawing showing a formation isolation valve joined to the portion of the lower completion shown in FIG. 3.

The combination of liner 14, quick connector 12, and orienting nipple 24 can be repeated as needed to obtain any desired length for lower completion 10, as shown in FIG. 3. Lines 22 are attached to lower completion 10 as described above. In addition, downhole tools may similarly be added into lower completion 10 using orienting nipples 24 and quick connectors 12. FIG. 4 shows such an embodiment with a formation isolation valve (FIV) 28 placed in lower completion 10.

Once the desired lower completion 10 has been assembled and run into the wellbore, it is desirable to cement lower completion 10 in place. Many methods are known for doing this, and the following described tools and method are exemplary only and not intended to be limiting.

Figure 5:
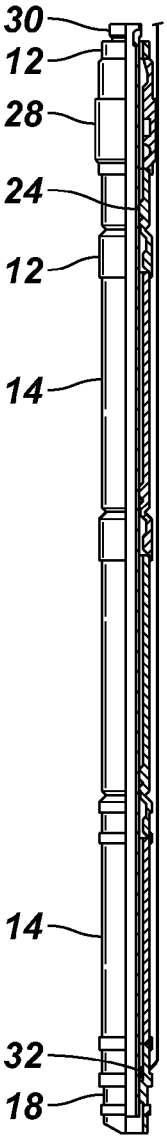
FIG. 5 is a partially cutaway schematic drawing showing a wash pipe run into the interior of the portion of the lower completion shown in FIG. 4.

FIG. 5 shows a wash pipe 30 that has been run into the interior of lower completion 10. Wash pipe 30 is run in until it stabs into PBR 18, where it engages a seal that blocks fluid flow into the annular region between wash pipe 30 and the interior of lower completion 10. Wash pipe 30 is used to convey the cement through lower completion 10 without contaminating and affecting the orienting nipples 24 and the equipment run with and inside lower completion 10. FIG. 5 also shows an FIV shifting tool 32. FIV shifting tool 32 toggles FIV 28 open or closed each time it passes FIV 28.

Figure 6:
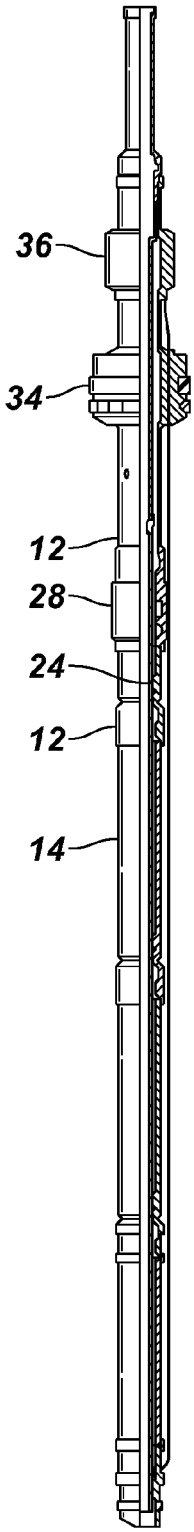
FIG. 6 is a partially cutaway schematic drawing showing a cementing service tool run inside the lower portion of a wet mate connector that has been run into the wellbore and connected to the wash pipe and the portion of the lower completion shown in FIG. 5.

An uppermost portion of lower completion 10, shown in FIG. 6, is then run into the wellbore over wash pipe 30 and connects to the rest of lower completion 10 via a quick connector 12. The uppermost portion includes a liner hangar packer 34 and a wet connector 36. Lines 22 will be connected to the upper completion using wet connector 36, as is known in the art.

Figure 7:
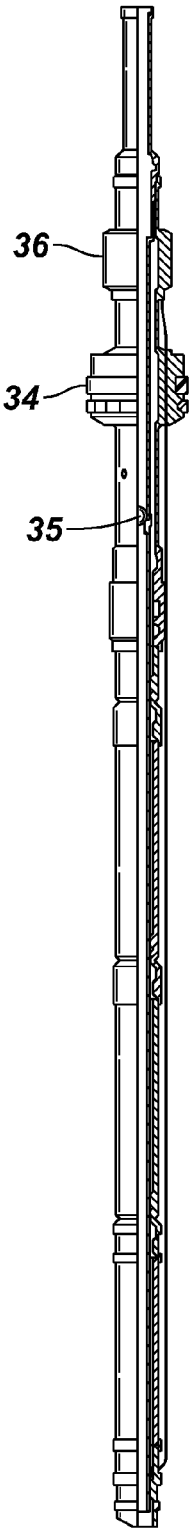
FIG. 7 is a partially cutaway schematic drawing showing a ball pumped into a ball seat in the interior of the cementing service tool shown in FIG. 6.
Figure 8:
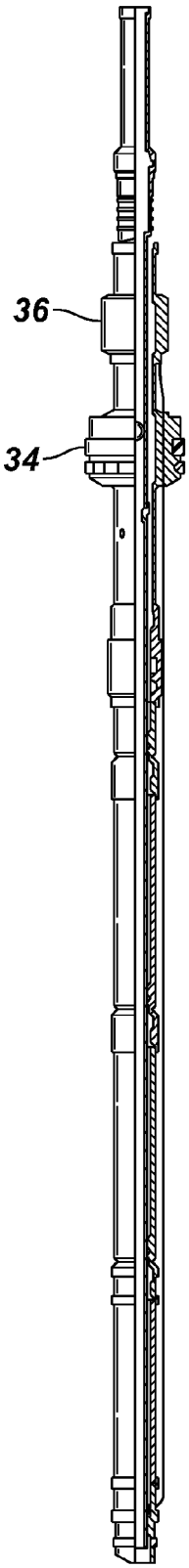
FIG. 8 is a partially cutaway schematic drawing showing the cementing service tool released from the lower completion shown in FIG. 6.
Figure 9:
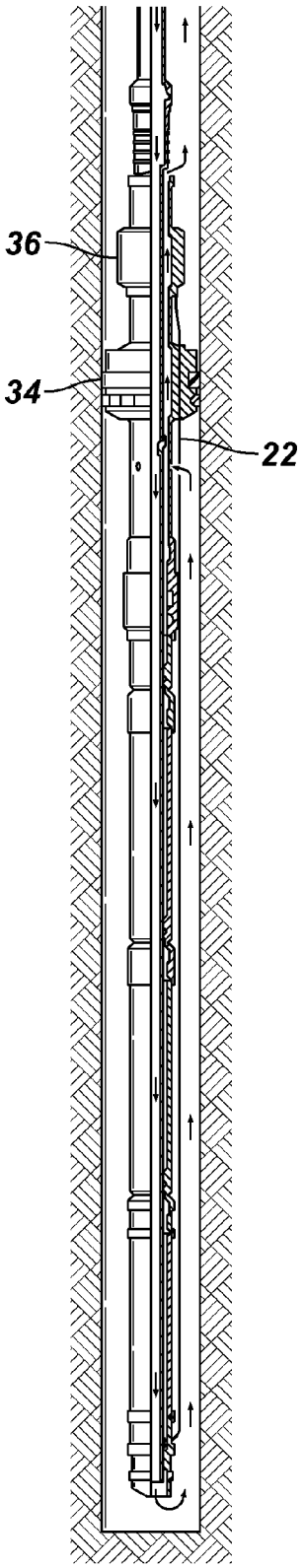
FIG. 9 is a partially cutaway schematic drawing showing the cementing fluid path for cementing the lower completion shown in FIG. 6.
Figure 10:
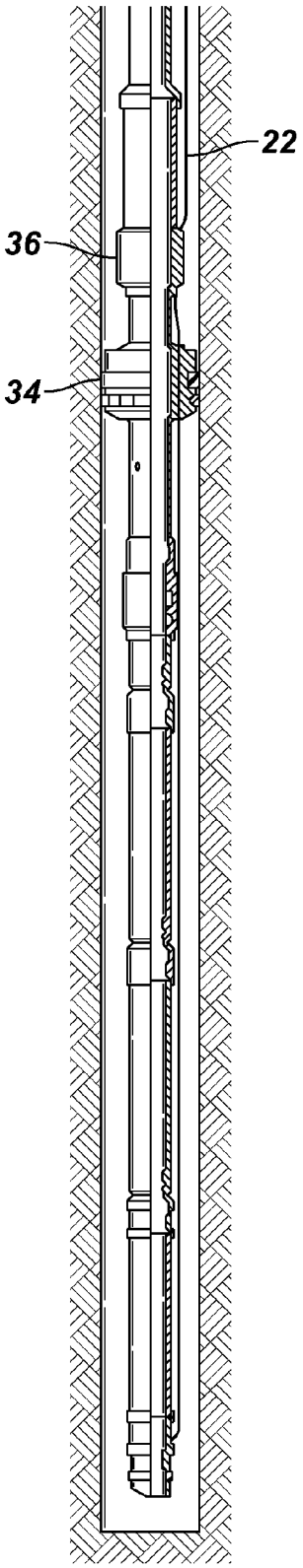
FIG. 10 is a partially cutaway schematic drawing showing the upper portion of the wet connector, run as the lowermost portion of the upper completion, joining the lower portion of the wet connector, run in the uppermost portion of the lower completion shown in FIG. 6.

To temporarily isolate the tubing below hangar 34, a ball 35 is pumped into a ball seat just below packer 34 (FIG. 7). This allows pressure to build up to a first desired level, causing packer 34 to set (i.e., expand, mechanically engaging and sealing against the wellbore wall). An upward pull may be applied to the tubing to test whether packer 34 set properly. If so, the tubing can be pressurized to a second desired level, higher than the first, to release the service tool, allowing the seals to come out of wet connector 36 (FIG. 8). Finally, the tubing may be pressurized to a third, even higher, desired level to remove the ball 35 and re-establish fluid communication with wash pipe 30. Cement can then be pumped through wash pipe 30 and ultimately into the annulus between the wellbore wall and lower completion 10, thereby cementing lower completion 10 in place with lines 22 along the exterior of lower completion 10 (FIG. 9). Once the cementing job is complete, the service tool and wash pipe 30 may be removed from the wellbore, toggling FIV 28 as FIV shifting tool 32 passes. The upper completion is then run into the wellbore and the upper portion of lines 22 join the lower portion via wet connector 36 (FIG. 10). The upper completion tubing and packer are tested and set against the closed FIV 28 on lower completion 10.

Because of the expense involved, it is prudent to use a logging tool to determine with certainty that the operations produced the desired results. An evaluation may be performed to validate the cementing job and to confirm line orientation. For example, one available logging tool combines pulse-echo technology with an ultrasonic technique—flexural wave imaging—to accurately evaluate any type of cement, from slurries and heavy cements to lightweight and foam cements. To confirm line orientation, prior to running in, a radioactive tag may be placed on recess key 26 to serve as a reference point for the position of lines 22.

Figure 11A:
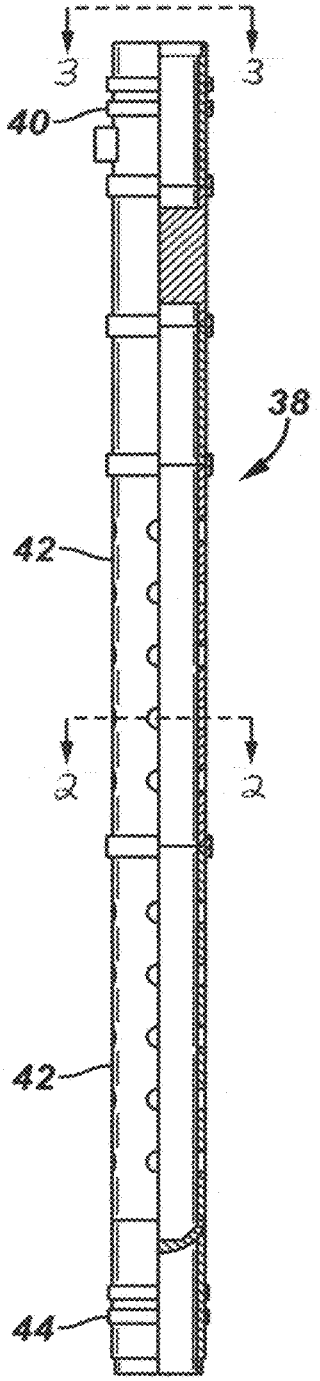
FIG. 11A is a partially cutaway schematic drawing showing a perforating string used to perforate the lower completion shown in FIG. 6.
Figure 11C:
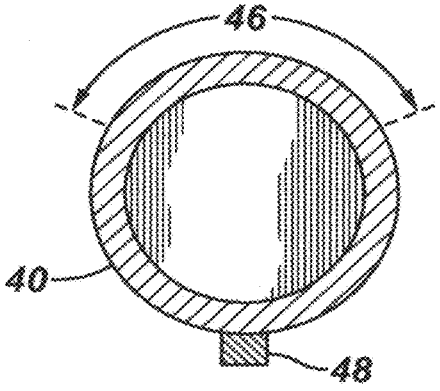
FIG. 11C is a cross-sectional view of the perforating string shown in FIG. 11A, taken through the orienting shifting tool.
Figure 11B:
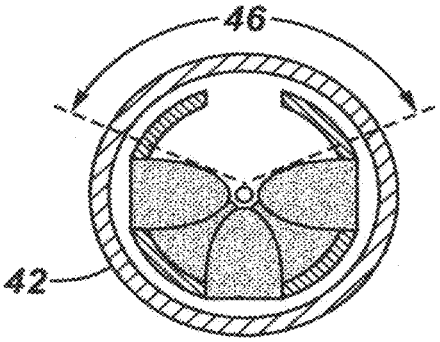
FIG. 11B is a cross-sectional view of the perforating string shown in FIG. 11A, taken through one of the gun sections.

Before formation fluids can be produced, liner 14 must be perforated to allow fluid communication between the formation and the interior of liner 14. Perforations are made using a perforating device, as described above. It is desirable that lines 22 not be severed by the shaped charges. FIG. 11A shows a perforating string 38. Perforating string 38 includes an orienting shifting tool 40, gun sections 42, and an FIV shifting tool 44 (functionally the same as FIV shifting tool 32). Gun sections 42 carry the shaped charges, as shown in FIG. 11B. FIG. 11B also shows a shaped charge free blank section 46 (i.e. having no shaped charges). Because the shaped charges, when fired, are directed radially outward, from a vertical perspective, no perforations are made in the liner and formation facing blank section 46. Thus, lines 22 of FIGS. 9 and 10 will not be severed if the vertical blank section 46 is oriented facing the vertical lines 22.

That desired orientation is achieved using orienting shifting tool 40. FIG. 11C shows an orienting key 48 on orienting shifting tool 40. Orienting key 48 may be oriented 180 degrees away from blank section 46. Other orientations are possible. Recall recess key 26 is oriented 180 degrees away from lines 22. Thus, when perforating string 38 is run into the interior of lower completion 10, orienting key 48 is guided into and ultimately aligns with recess key 26 by orienting nipple 24. When so aligned, the perforating guns may be fired to establish the desired fluid communication without damaging lines 22. Once fired, perforating string 38 may be removed from the interior of lower completion 10. FIV shifting tool 44 again toggles FIV 28 as it passes.

Orienting nipples 24 can have distinct nipple profiles 25 (FIG. 12), meaning the perforating string, for example, can be selectively located in lower completion 10. Thus, different zones may be independently perforated. Again, being able to toggle FIV 28 open and closed helps to enable this ability.

While preferred embodiments have been described herein, those skilled in the art, having benefit of this disclosure, will appreciate that other embodiments are envisioned that do not depart from the inventive scope of the present application. Accordingly, the scope of the present claims or any subsequent related claims shall not be unduly limited by description of preferred embodiments herein.

What is claimed is:

1. A downhole perforating system, comprising:

a cemented-in lower completion comprising a casing and a liner hung from the casing, one or more orienting nipples, each orienting nipple having a nipple profile to correlate downhole depth, a recess key, and a guiding surface having a lower end that terminates into the recess key, the recess key having an open upper end adjacent to the lower end of the guiding surface and a closed lower end distal to the open upper end and not in contact with the guiding surface, and one or more lines or tools carried on the exterior of the lower completion and oriented relative to the recess key; and a perforating string having a shaped charge free vertical blank section oriented relative to and by an orienting key on an orienting shifting tool that is brought into alignment with the recess key and disposed between the open upper end of the recess key and the closed lower end of the recess key when the perforating string is landed in the orienting nipple;

wherein the perforating string further comprises a formation isolation valve shifting tool located near the lower end of the perforating string to change a state of a formation isolation valve as the perforating string is run into the interior of the lower completion.

2. The perforating system of claim 1, wherein the lower completion further comprises one or more quick connectors, each quick connector having an upper orienting sub and a lower orienting sub.

3. The perforating system of claim 2, wherein the quick connectors affix the lines or tools to the exterior of the lower completion and orient the lines relative to a point on the lower completion.

4. The perforating system of claim 2, wherein the recess key corresponding to a particular orienting nipple is oriented relative to a point on the lower completion when that orienting nipple is joined to any one of the quick connectors.

5. The perforating system of claim 1, wherein each of the orienting nipples has a distinctive inner profile.

6. The perforating system of claim 1, wherein the lines or tools are oriented 180 degrees from each of the recess keys.

7. The perforating system of claim 1, wherein the lower completion further comprises a formation isolation valve, a packer, and a wet connector located near the upper end of the lower completion.

8. The perforating system of claim 1, wherein the lower completion further comprises at least one of a downhole tool and a turnaround sub, a polished bore receptacle, and a re-entry guide located near the lower end of the lower completion.

9. The perforating system of claim 1, wherein the perforating string includes shaped charges in sections other than the blank section.

10. The perforating system of claim 1, wherein the blank section is oriented 180 degrees from the orienting key.

11. A method to perforate a lower completion disposed in a wellbore, comprising:

providing the lower completion, wherein the lower completion comprises a casing and a liner hung from the casing, one or more orienting nipples, each orienting nipple having a nipple profile to correlate downhole depth, a recess key, and a guiding surface having a lower end that terminates into the recess key, the recess key having an open upper end adjacent to the lower end of the guiding surface and a closed lower end distal to the open upper end and not in contact with the guiding surface, and one or more lines or tools carried on the exterior of the lower completion and oriented relative to the recess key;

disposing the lower completion in the wellbore;

cementing in place the lower completion disposed in the wellbore;

connecting the lines or tools to an upper completion using a wet connector;

running into the interior of the lower completion a perforating string having a shaped charge free vertical blank section oriented relative to and by an orienting key on an orienting shifting tool that is brought into alignment with the recess key and disposed between the open upper end of the recess key and the closed lower end of the recess key when the perforating string is landed in one of the orienting nipples;

changing a state of a formation isolation valve as the perforating string is run into the interior of the lower completion; and perforating the lower completion by firing shaped charges carried on the perforating string without damaging the lines or tools carried on the exterior of the lower completion.

12. The method of claim 11, further comprising using quick connectors to affix the lines or tools to the exterior of the lower completion and orient the lines relative to a point on the lower completion.

13. The method of claim 12, further comprising orienting the lines or tools 180 degrees from each of the recess keys.

14. The method of claim 11, further comprising selectively landing the perforating string in a particular orienting nipple.

15. The method of claim 11, further comprising using the orienting shifting tool to orient the orienting key relative to the lines or tools.

16. The method of claim 15, further comprising orienting the lines or tools 180 degrees from the orienting key.

* * * * *